US005258727A

United States Patent [19]

DuPuis et al.

[11] Patent Number: 5,258,727

[45] Date of Patent: Nov. 2, 1993

[54] MICRORIBBON/WAVEGUIDE TRANSITION FOR PLATE TYPE ANTENNA

[75] Inventors: Philippe DuPuis, Perros; Jean-Luc Alanic, Treguier, both of France

[73] Assignee: Centre Regional d'Innovation et de Transfert Den, Lannion, France

[21] Appl. No.: 869,145

[22] Filed: Apr. 14, 1992

[30] Foreign Application Priority Data

Apr. 16, 1991 [FR] France ..... 91 04773

[51] Int. Cl.[5] ..... H01P 5/107; H01Q 9/16

[52] U.S. Cl. ..... 333/26; 333/35; 343/859; 343/865

[58] Field of Search ..... 333/26, 35; 343/700 MS, 343/859, 865

[56] References Cited

U.S. PATENT DOCUMENTS 3,942.138 3/1976 Schaedla ..... 333/26 X
4,899.163 2/1990 Daniel et al. ..... 343/700 MS

FOREIGN PATENT DOCUMENTS 131605 6/1987 Japan ..... 343/700 MS
1247979 7/1986 U.S.S.R. ..... 333/26

OTHER PUBLICATIONS

Weiss, *Microstrip Antennas for Millimeter Waves*, IEEE Trans. on A&P, vol. AP-29, No. 1, Jan. 1981, pp. 171-174.

*Primary Examiner*—Paul Gensler
*Attorney, Agent, or Firm*—Laff, Whitesel, Conte & Saret

[57] ABSTRACT

The present invention relates to a microribbon/wave guide line transition, especially between an antenna (1) of the plate antenna type, with radiating elements (3) and feed lines (4) printed on a face of a substratum (2) and a wave guide or a resonant cavity (12) with a rectangular section. The end wall of the wave guide or of the cavity (12) is in a plane parallel to the plane that contains the radiating elements (3) of antenna (1) and their feed lines (4). The transition comprises a conductor a first end of which is in galvanic contact with the main feed point A of the antenna (1) and that runs through the substratum (2) of antenna (1) in the direction of its thickness and that comes out into the wave guide or cavity (12) through a hole (9) in the end wall of the wave guide or of said cavity (12), the second end of said conductor is in galvanic contact with a wide internal lateral wall of the wave guide or of the cavity (12), approximately in the middle of same, in the transverse direction of same, and at a distance of the end wall equal to approximately one quarter the length of the wave guided in the wave guide or cavity (12), the plane that contains the conductor is approximately perpendicular to the wide lateral wall (12'') of the wave guide or cavity (12).

7 Claims, 4 Drawing Sheets

MICRORIBBON/WAVEGUIDE TRANSITION FOR PLATE TYPE ANTENNA

The present invention relates to a microribbon/wave guiding transition line, especially between an antenna of the plate antenna type with microribbon line and a wave guide or a resonant cavity.

There are known transitions between microribbon line devices and wave guides, and there will be mentioned, as example, the patent documents DE-A-2 421 795, DE-A-3 033 674 and EP-A-94 478.

In this latter document, a microribbon line laterally penetrates into the wave guide, parallel to its end wall, through a channel provided in its lateral wall. The position of that channel in the lateral wall is such that the microribbon line on the inside of the wave guide plays the part of the sensor that energizes the main modes of propagation of the wave guide.

The patent document DE-A 241 795 describes a transition in which the wave guide energizing element is an antenna. The feed to that antenna is done through a line that there also, enters the wave guide in a lateral direction.

In document DE-A-3 033 674, the planned transition is provided, inside a resonant cavity, with a loop of relatively small size relative to one quarter of the length of the wave guided inside the wave guide. The feed to that loop may be done through a passage provided for in the end wall of the wave guide.

These transitions present a problem of assembling when they are to be used to connect a plate antenna with microribbon lines to a resonant cavity or to a wave guide. Indeed, the wave guide or the cavity can be placed only on one edge of that plate antenna in order for a microribbon line to be able to laterally penetrate into the wave guide. There follows from this problems of fixation of the wave guide to the antenna plate.

The purpose of the present invention is to provide for a transition such as those just described, but that does not have their drawbacks.

Another purpose of the invention is to provide a transition with a technology relatively simple in execution.

These purposes are achieved with a transition characterized in that an end wall of a wave guide or of a cavity with a rectangular section, is located in a plane parallel to the plane that contains radiating elements of the antenna and their feed lines, said transition comprising a conductor having a first end of which is in galvanic contact with the main feed point of the antenna, that runs through the substratum of the antenna in the direction of its thickness, and that comes out in the wave guide or the cavity through a perforation in the end wall of the above wave guide or above cavity, the second end of that conductor being in galvanic contact with a wide internal lateral wall of the wave guide, approximately in the middle, crosswise, of that wall and at a distance of said end wall that is equal to approximately one quarter the length of the wave guided in said wave guide or in said cavity, the plane that contains the conductor being approximately perpendicular to the wide lateral wall of said wave guide or cavity.

According to a first variation in execution that is characteristic of the invention, the substratum of the antenna is covered, on its rear face, with a layer of metallic material that forms, on one part a ground plane for said antenna and on the other part, the end wall of said wave guide or of said cavity, the transition conductor running through that layer through a hole pierced in said layer and opening inside the wave guide or inside the cavity, the diameter of that hole and the diameter of the conductor being such that they form a coaxial bond with a characteristic impedance that is pre-set.

According to a second variation in execution that is characteristic of the invention, the substratum of the antenna is mounted on a sole plate the two faces of which respectively are covered with two metallic layers, the conductor traversing that sole plate through a hole, the first metallic layer in contact with the substratum of the antenna forming the ground plane of that antenna, and the second metallic layer forming the end wall of the wave guide or of the cavity.

According to another characteristic of the invention, the wall of the hole in the sole plate is metallized and it is filled with a dielectric material, the diameter of the conductor and the diameter of the hole in the sole plate being such that the connection in said sole plate is of the coaxial type with a pre-set impedance characteristic.

According to another characteristic of the invention, the conductor enters the wave guide at approximately the center of the end wall of said wave guide or of said cavity.

According to another characteristic of the invention, the conductor enters said wave guide or cavity at a point that is shifted, relative to the center of the end wall, toward the internal lateral wall of the wave guide or of the cavity that is located opposite that receiving the second end of the conductor.

According to another characteristic of the invention, the wave guide or the cavity are constituted by a metallic base equipped with a hollowed out part running through it completely and that has the same section as that of the remainder of the wave guide or cavity, its height being approximately one quarter of the length of the wave guided in the wave guide or in the cavity, the second end of that conductor being clamped between the base and the wave guide or cavity.

The above-mentioned characteristics of the invention, as well as others, will appear more clearly upon reading of the following description of an example of execution, that description being given with reference to the attached drawing in which.

Figure 1:
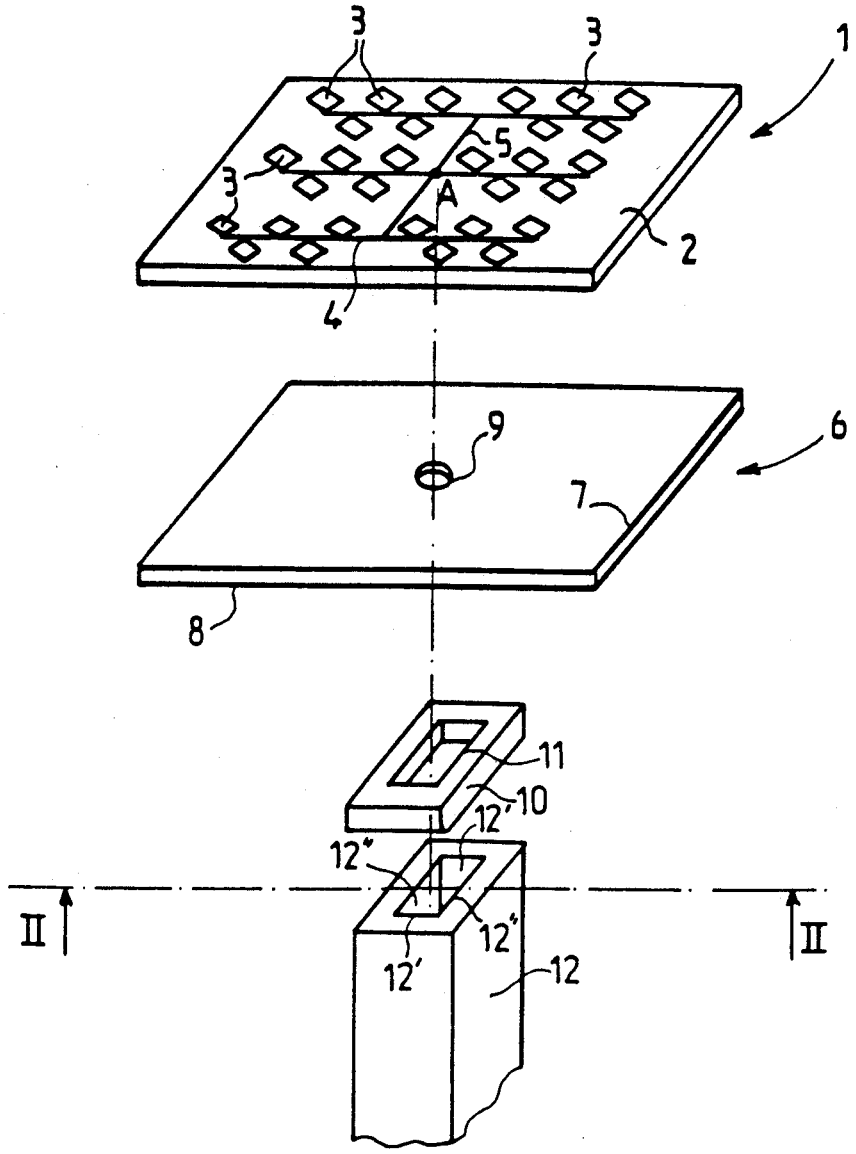
FIG. 1 is a perspective view of an antenna, of a wave guide and of a transition according to the present invention, each element being dissociated from the others but in a relative position, ready for assembling.

In FIG. 1, there is seen a plate antenna 1 that comprises, on the upper face of a substratum radiating elements 3 and their feed lines 4 of the microribbon type. It is, for example, manufactured by the printed circuit technique. The substratum 2 may be, for example, constituted of a material of the polypropylene type. Antenna 1 is fed in a point A located on a feed line 5.

There is also seen a sole plane 6 meant to receive the antenna 1 on its upper face. It is made of epoxy glass and has two faces, that respectively are covered with metallic layers 7 and 8, brought to the potential of the ground. The layer 7 of the upper face of the sole plate 6 constitutes a ground plane for antenna 1 when the latter is mounted on sole plate . In alignment with the feed point A of antenna 1, the sole plate 6 is equipped with a cylindrical hole 9 the internal wall of which also is metallized.

In contact with the layer 8 of the lower face of sole plate 6, there is provided a base 10 constituted by a parallelepiped-shaped metallic block equipped, at the centers of its two horizontal surfaces, with a hollowed out area also parallelepiped shaped, that runs through it from side to side. The base 10 is mounted on the sole plate 6 in a manner such that hole 9 opens in the volume developed by the hollowed out part 11 of the base 10. The base 10 is meant to receive a wave guide or a resonant cavity 12 and it constitutes a part of same. The internal volume of the wave guide or of the cavity 12 has the same section as that of the hollowed out part 11 that is to say it is rectangular. The face 12' of the wave guide or cavity 12 that is located in the plane of FIG. 2 is a lateral face of width compared to the faces 12" perpendicular to it, that are wide lateral faces of the wave guide.

Hereafter the word "wave guide" shall be used indifferently to designate a wave guide or a resonant cavity.

Figure 2:
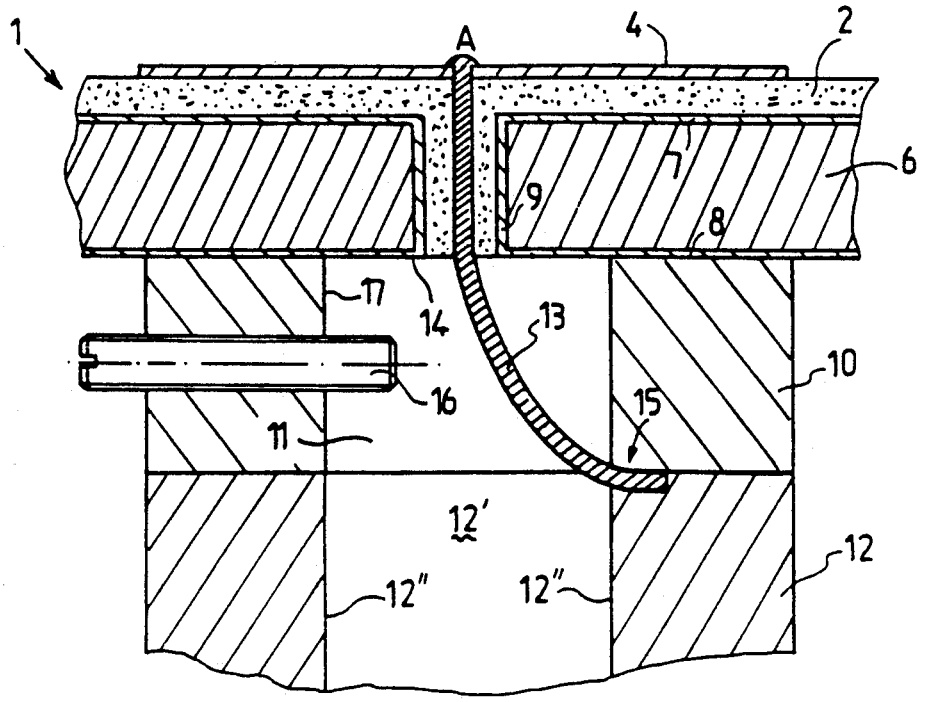
FIG. 2 is a section view along median plane II/II of FIG. 1 of a transition according to the present invention.

In FIG. 2, there are shown in section the different elements of FIG. 1. Thus there is seen in it the antenna with its substratum and a feed line 4, the sole plate 6 with its upper and lower metallic layers 7 and 8, and its metallized hole 9, as well as the base 10 and a part of the wave guide 12.

The micro ribbon/wave guide transition line according to the present invention is executed by means of a metallic conductor 13 that has one end in galvanic contact with the feed line 4 of antenna 1 at point A shown in FIG. 1, and its second end on the inside of the wave guide 12, as will be seen below. It first runs, in the direction of its thickness through substratum 2 of antenna 1 and then, in the same direction and passing in hole 9, through the sole plate 6. The hole 9 contains a dielectric material of the same nature as the material that constitutes the substratum 2.

Let us note that the filling of hole 9 in the sole plate 6 can be obtained by pressing of a layer of polypropylene on sole plate 6, that layer then serving as substratum 2 for the antenna.

The diameter of hole 9 of the sole plate 6 and the diameter of the conductor 13 are such that the connection between the antenna and the wave guide is of the coaxial type with a pre-set characteristic impedance. That impedance is, for example, 50 Ohms. This makes it possible to prevent the antenna/wave guide transition from disturbing the operation of the antenna by parasitic radiations coming from diffractions at point A of the antenna feed.

Conductor 13 then enters the volume formed by the hollowed out area 11 of base 10. The part of the metallic layer 8 that is located inside the hollowed-out part of base 10 constitutes an end wall 14 of the wave guide formed by the base 10 and the guide 12 itself. Conductor 13 thus enters into that wave guide through wall 14, approximately at the center of same.

The second end of conductor 13 is in galvanic contact with the body of base 10, approximately in the middle of the wide lower lateral edge 15 formed by hollowed out area 11. It is clamped between base 10 and the wave guide 12. The point of contact of conductor 13 with the base 10 is at approximately $\lambda g/4$ from the layer 8 that constitutes the end wall 14 of the wave guide, $\lambda g$ being the length of the wave guided in the wave guide 12. In practice, the thickness of the base 10 is approximately equal to $\lambda g/4$.

It will be noted that the end of conductor 13 is in galvanic contact with a wide lateral face 12" of the wave guide 12, and that the place that contains it is perpendicular to that face 12".

Conductor 13 is placed in a slanting direction within the internal volume developed by the hollowed-out area 11 of the base 10. Advantageously, it has the shape of the arc of a circle, with its convexity turned toward the inside of wave guide 12. It could also comprise a 90 degrees elbow.

A screw 16 for regulating the agreement frequency of the wave guide 12 is provided at the approximate center of the lateral wall 17 of the hollowed-out area 11 that is opposite the one receiving conductor 13.

Figure 3:
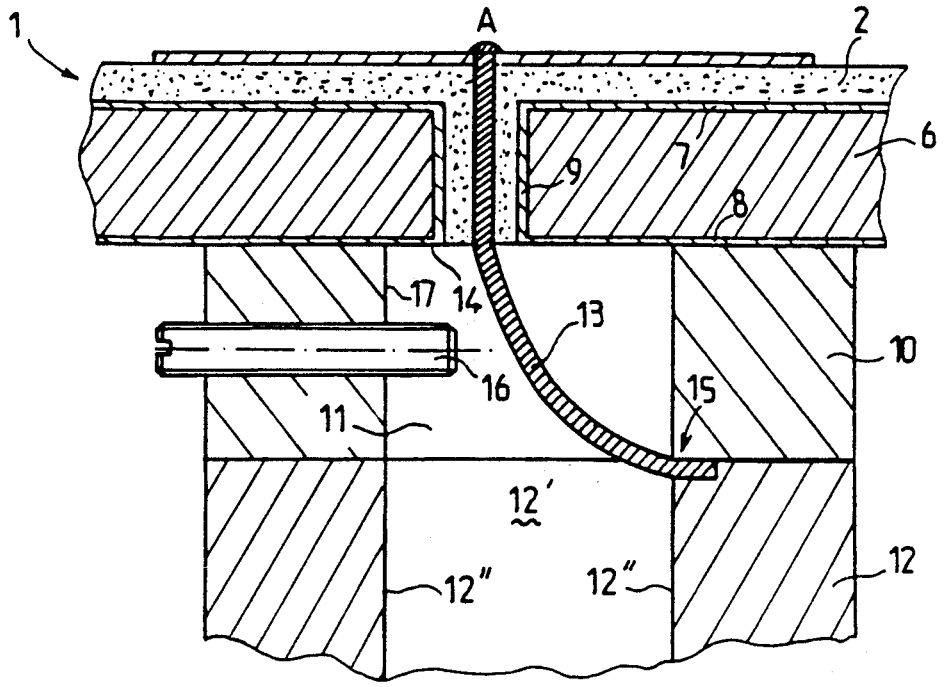
FIG. 3 is a variation in execution of the transition shown in FIG. 2.

According to a variation in execution of the invention, shown in FIG. 3, the conductor 13 enters the volume developed by the hollowed out area 11 of the base 10 with a slight shift in a median plane of base 10, toward the lateral wall 17 of the hollowed out area 11 that is located opposite the one receiving the end of conductor 13.

There has been executed a transition such as the one just described with respect to FIG. 2, for operation at a frequency of the order of 24 GHz. The height of the base 10 is 4 mm, the width of the hollowed out area of the base 10 that corresponds to the width of the wave guide 12 and to the distance between the wall 17, and the wall that receives the end of conductor 13 is 4.3 mm, the diameter of conductor 13 is 0.65 mm and the diameter of perforation 9 in the sole plate 6 is 2.3 mm.

Figure 4:
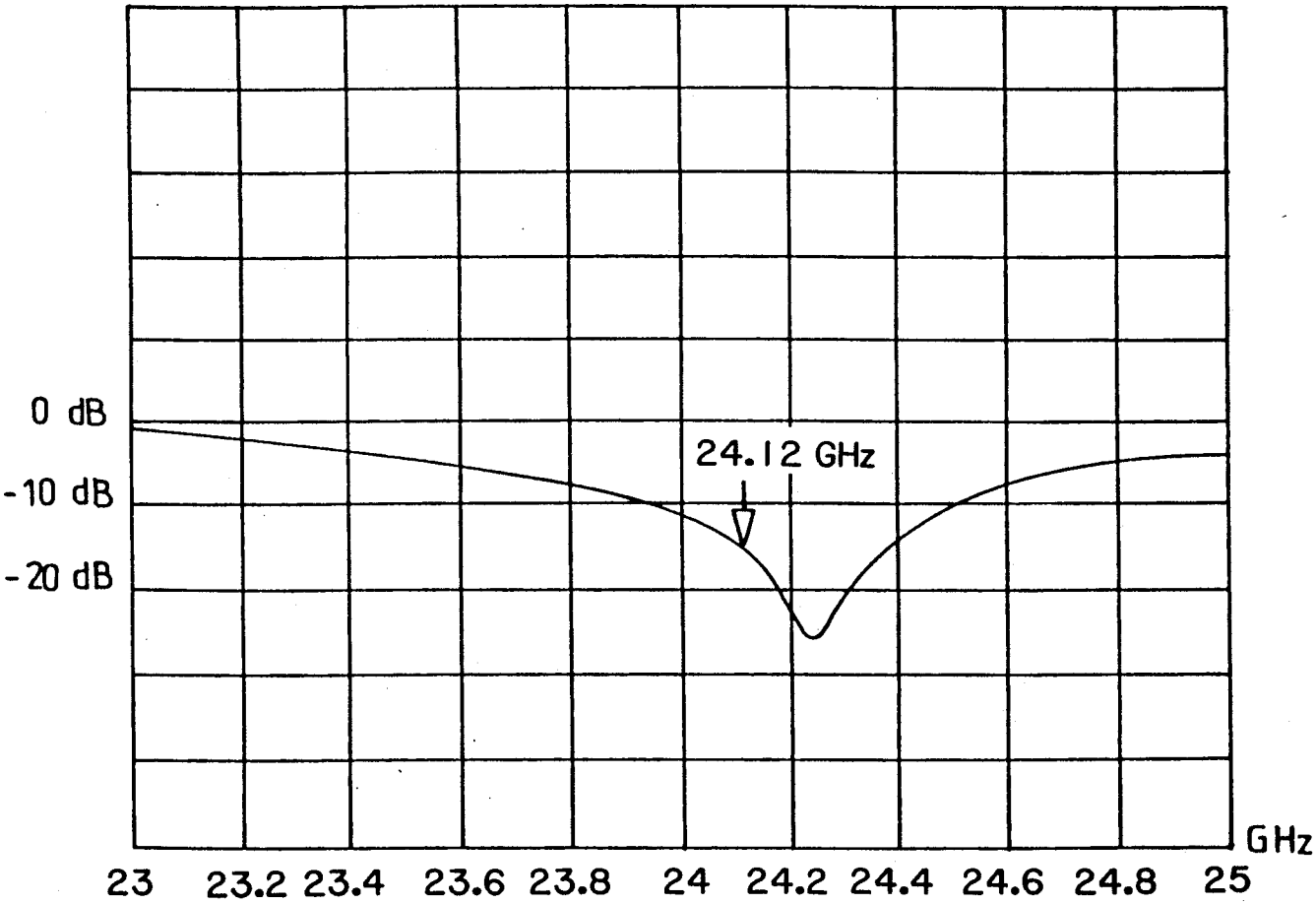
FIG. 4 is a curve of the reflection coefficient characteristic of a transition according to the invention, as a function of its frequency of operation.

FIG. 4 shows the curve of the reflection coefficient expressed in decibels as a function of the frequency of operation obtained with an antenna 1 equipped with such a transition. The measuring apparatus is connected in place of the wave guide 12.

The passing band at −3 db is very narrow and it ranges between 23.4 GHz and 24.8 GHz, with a minimum of the reflection coefficient at 24.25 GHz. The passing band is of the order of 5% of the operation frequency.

An adjustment of the operation frequency may be achieved with the screw 16.

Figure 5:
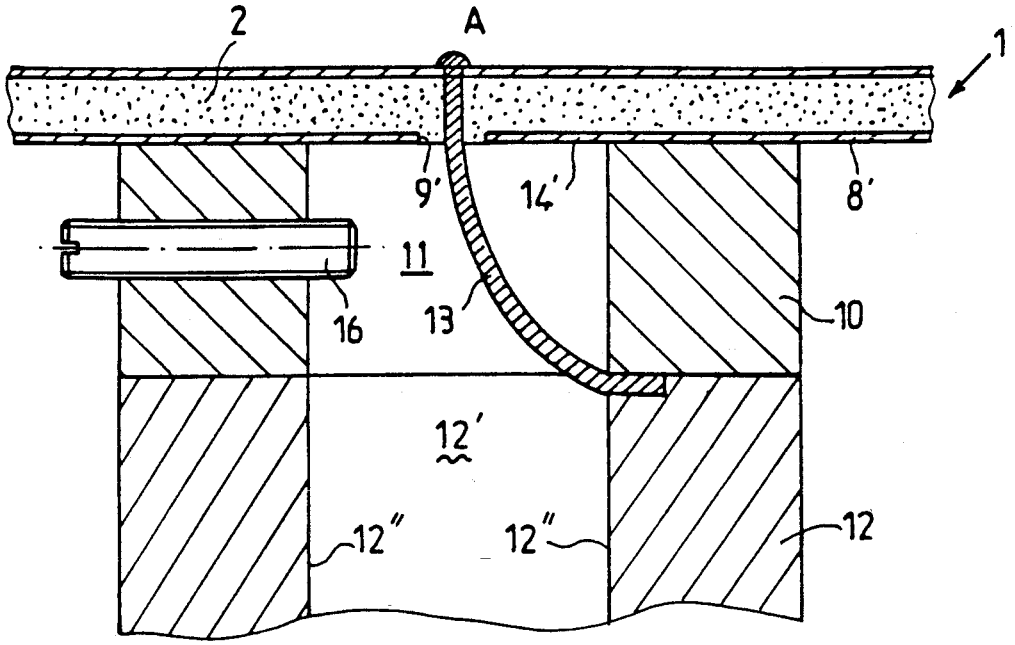
FIG. 5 is a variation in the execution of the invention.

A variation in execution of a transition according to the present invention is shown in FIG. 5. The substratum 2 of the antenna 1 has its lower face covered with a metallic layer 8' that, on the one part forms the ground plane of the antenna 1 and, on the other part, the end wall 14' of the wave guide 12 and of its base 10. The base 10 is mounted in direct galvanic contact with the layer 8, Conductor 13 that constitutes the transition runs through substratum 2 in the direction of its thickness and it comes out, through an opening 9' pierced in the layer 8', in the volume developed by the hollowed-out part 11 of base 10. With the walls of the perforation 9' inside the layer 8', conductor 14 forms a coaxial type connection of very limited thickness, the characteristic impedance of which is pre-set.

The end of conductor 13 is mounted on the base 10 in the same manner as in the preceding variations.

The operation of this transition is appreciably the same as in the transitions shown before.

In the present description, there has been described a base 10 on which there is mounted a wave guide or a resonant cavity 12. It is easy to understand that it would be possible directly to use a wave guide or a cavity with suitable means, to put the end of conductor 13 in galvanic contact with the lateral wall of that wave guide 12 at a distance of the order of $\lambda g/4$ of the end wall 14, of that guide or of that cavity 12.

We claim:

1. A microribbon/wave guide line transition, between an antenna (1) of the plate type antenna, with radiating elements (3), and feed lines (4) printed on a face of substratum (2) and a resonant wave guide (12) with a rectangular cross section, an end wall (14, 14') of the wave guide (12) being located in a plane parallel to a plane that contains said radiating elements (3) of the antenna (1) and their feed lines (4), said transition comprising a metal block (10) having a frequency adjusting screw projecting into a cavity (11) of said block, said metal block being interposed between said wave guide (12) and said antenna, said cavity (11), in said metal block dimensionally matching said wave guide, a conductor (13) having a first end in galvanic contact with a main feed point (A) of said antenna (1), said conductor extending through said substratum (2) of said antenna (1) in the direction of its thickness and coming out inside the cavity (11) in said block (10), said conductor passing through an opening (9, 9'), in the end wall of said block cavity (11), the second and opposite end of said conductor (13) being in galvanic contact with a wide internal lateral wall of the wave guide (12), and being located in approximately the middle of said waveguide (12) in the transverse direction, and at a distance from said end wall (14, 14') equal to approximately one quarter of the wave length of the wave guided in said wave guide (12), the plane containing said conductor being approximately perpendicular to a wide lateral wall (12'') of said wave guide (12).

2. A transition according to claim 1, wherein the substratum 2 of the antenna (1) is covered, on its rear face, with a layer (8') of a metallic material forming both a ground plane for said antenna (1) and the end wall (14') of said block (10) cavity (11), the conductor (13) of the transition traversing said layer (8') via a hole (9') pierced in said layer (8') and coming out in the inside of the block (10) cavity, the diameter of said hole (9') and the diameter of said conductor (13) being such that they achieve a coaxial connection having a predetermined characteristic impedance.

3. A transition according to claim 1, wherein the substratum (2) of the antenna (1) is mounted on a dielectric sole plate (6) having two faces respectively covered with two metallic layers (8, 9), the conductor (13) traversing said sole plate (6) through a hole (9), the first metallic layer (7) being in contact with the substratum (2) of the antenna in order to form a ground plane of said antenna and the second metallic layer (8) forming the end wall (14) of the block (10) cavity (11).

4. A transition according to claim 3, wherein the hole (9) in the sole plate (6) has a metallized side wall and is filled with a dielectric material, the conductor (13) having a diameter and the hole (9) in the sole plate (6) having a diameter such that the connection in said sole plate (6) is a coaxial type, with a predetermined characteristic impedance.

5. A transition according to any one of the claims 1 to 4, characterized in that the conductor (13) comes out into the block (10) cavity (11) at approximately the center of the end wall (14, 14') of said block (10).

6. A transition according to any one of claims 1 to 4, wherein the conductor (13) comes out into said block (10) cavity (11) at a point relative to the center of the end wall (14, 14') which is shifted toward a wide internal lateral wall (17) of the block (10) cavity (11) that is opposite a wide wall receiving the opposite end of the conductor (13).

7. A transition according to any one of the claim 1 to 4, wherein said block (10) comprises a metallic base (10) having a hollowed out area (11) that runs from one end through it to an opposite end, and has a cross-section which is the same as the cross section of the remainder of the wave guide (12), said area further having a height equal to approximately one quarter of the wave length of the wave being guided in the wave guide, and an end of said conductor (13) being clamped between said base (10) and said wave guide (12).

* * * * *